US006059021A

United States Patent [19]

Choi

[11] Patent Number: 6,059,021

[45] Date of Patent: May 9, 2000

[54] HORIZONTAL AIR DIRECTION CONTROL VANE ARRANGEMENT OF AN AIR CONDITIONER

[75] Inventor: Eun-Chang Choi, Suwon, Rep. of Korea

[73] Assignee: Samsung Electronics Co., Ltd., Suwon, Japan

[21] Appl. No.: 09/208,829

[22] Filed: Dec. 10, 1998

[30] Foreign Application Priority Data

Dec. 15, 1997 [KR] Rep. of Korea ..... 97-68901

[51] Int. Cl.[7] ..... F28F 9/22

[52] U.S. Cl. ..... 165/96; 454/233; 454/315; 454/319; 454/321

[58] Field of Search ..... 165/96; 454/233, 454/315, 319, 321, 313, 202

[56] References Cited

U.S. PATENT DOCUMENTS

| | | | |
|---|---|---|---|
| 5,234,373 | 8/1993 | Yamazaki et al. | 454/319 |
| 5,626,517 | 5/1997 | Kil | 454/315 |
| 5,873,780 | 2/1999 | Mori et al. | 454/315 |
| 5,888,133 | 3/1999 | Mori et al. | 454/315 |
| 5,943,872 | 8/1999 | Sakurada et al. | 454/315 |

*Primary Examiner*—Ira S. Lazarus
*Assistant Examiner*—Tho Duong
*Attorney, Agent, or Firm*—Burns, Doane, Swecker & Mathis, L.L.P.

[57] ABSTRACT

An air conditioner includes an air inlet, an air outlet, a heat exchanger disposed between the air inlet and air outlet, and an air direction control mechanism at the air outlet for regulating a direction of air discharge. The regulating mechanism includes a support member having slots, and a plurality of vanes each having a projection configured correspondingly to the slots so that once the projections have been inserted through the respective slots and then rotated, the vanes are secured to the support member. Each projection includes a hinge axle about which the vane rotates, and a pair of compression protruders projecting from opposite sides of the hinge axle. The protruders bear elastically against one surface of the support member to pull a flange portion of the vane into engagement with another surface of the support member. One of the protruders of each vane carries a fixation axle which snaps into a respective open-sided hole of a connecting member. The vanes can be rotated by sliding the connecting member, whereupon all of the vanes rotate in unison.

10 Claims, 8 Drawing Sheets

HORIZONTAL AIR DIRECTION CONTROL VANE ARRANGEMENT OF AN AIR CONDITIONER

BACKGROUND OF THE INVENTION

1. Field of the Invention

The present invention relates to an air conditioner, and more particularly to a left-right air direction control apparatus of an air conditioner adapted to control the flow of air discharged in the right-to-left direction.

2. Description of the Prior Art

Generally, air conditioners can be classified into an exclusive cooling air conditioner, a cooling/humidifying exclusive air conditioner, and a cooling-or-heating air conditioner according to function, and can be classified into an integral type air conditioner and a separation type air conditioner according to structure.

The cooling-or-heating air conditioner is operated by one system incorporating an indoor unit and an outdoor unit and performs a heating or a cooling operation according to a user's need. The indoor unit 10 according to the conventional separation type air conditioner is provided with a front panel 20 and a rear panel 30 to form an exterior appearance, as illustrated in FIG. 1.

The front panel 20 is arranged with a front grill 40 and a discharge outlet 50 which is in turn provided with vertical air direction control means 60 for controlling the up-down direction of air discharge.

The indoor unit 10 is provided therein with an air filter 70 which is disposed in front of an evaporator 80. The evaporator 80 is provided at a rear side thereof with a blower 90 for blowing heat-exchanged air into the room through the discharge outlet 50.

The discharge outlet 50 is provided with a plurality of horizontal air direction control means 100 for controlling the left-right direction of air discharge.

The vertical air direction control means 60 is automatically controlled by a driving motor (not shown) disposed at one side of the indoor unit 10, and the horizontal air direction control means 100 is automatically or manually controlled by a driving motor (not shown) mounted at the other side of the indoor unit 10.

In other words, the horizontal air direction control means 100 is provided as illustrated in FIGS. 2 and 3, with a plurality of swing vanes 110, a support member 120, a cover member 130 and a connecting member 140. At this time, each of the swing vanes 110 has a body 111 integrally formed with a hinge axle 112, a fixing axle 113 and a handle 114. The vanes can be swung by a motor (not shown) which slides the connecting member, or swung manually by a user by means of the handle 114.

The support member 120 is formed at an upper end thereof with a drain tray surface 121 which is in turn provided therein with a plurality of hitching protruders 122 and is provided with a plurality of hinged grooves 123 disposed under the hitching protruders.

Furthermore, the drain tray surface 121 is provided at a predetermined interval with a plurality of hitching grooves 124 and screw holes 125. The cover member 130 is formed lengthwise at predetermined intervals with a plurality of hitching grooves 131 under which there is formed a plurality of hinge grooves 132. The hinge grooves 123 and 132 are alignable with one another to rotatably support the hinge axles 112.

The cover member 130 is integrally provided with a plurality of elastic hitching protruders 133 and with a plurality of brackets 134, respectively. The connecting member 140 is formed with a plurality of fixation holes 141.

However, there is a problem in the conventional horizontal air direction control apparatus in an air conditioner thus constructed in that the hinge grooves 123 and 132 can develop improper driving and frictional noises during rotation of the hinge axles 112 due to warpage (discrepancy of dimensions), flash phenomenon or the like occurring at the hinged grooves 123 and 132.

Still worse, there is another problem in that the plurality of swing vanes 110 hinged by the support member 120 and the cover member 130 result in increased manufacturing costs due to the large number of parts involved therein and the resulting complexity of construction.

SUMMARY OF THE INVENTION

The present invention is presented to solve the aforementioned problems and it is an object of the present invention to provide a horizontal air direction control apparatus of an air conditioner in which air direction control vanes include projections that extend through respective slots of a support member so that the vanes become secured to the support member upon subsequent rotation of the vanes.

Another object is to reduce frictional noise during rotation of the vanes.

It is another object of the present invention to reduce the number of parts, thereby eliminating factors of cost increases.

In accordance with the objects of the present invention there is provided an air conditioner including an air inlet, an air outlet, a heat exchanger disposed between the air inlet and the air outlet, and an air direction control mechanism mounted at the air outlet for regulating a discharge direction of the air. That mechanism includes a support member having a water collecting portion for collecting condensed water from the heat exchanger, and a plurality of slots. A plurality of vanes is provided, each vane including a projection having a hinge axle and an eccentric drive coupling offset from the hinge axle. The projections are configured correspondingly to the slots so that each projection is insertable through a respective one of the slots and then securable to the support member in response to a turning of the projection about the hinge axle. A connecting member is connected to all of the drive couplings and is slidable for simultaneously rotating all of the vanes.

BRIEF DESCRIPTION OF THE DRAWINGS

The objects and advantages of the invention will become apparent from the following detailed description of preferred embodiments thereof in connection with the accompanying drawings in which like numerals designate like elements and in which.

For a fuller understanding of the nature and objects of the invention, reference should be made to the following detailed description taken in conjunction with the accompanying drawings in which.

DETAILED DESCRIPTION OF PREFERRED EMBODIMENTS OF THE INVENTION

Figure 1:
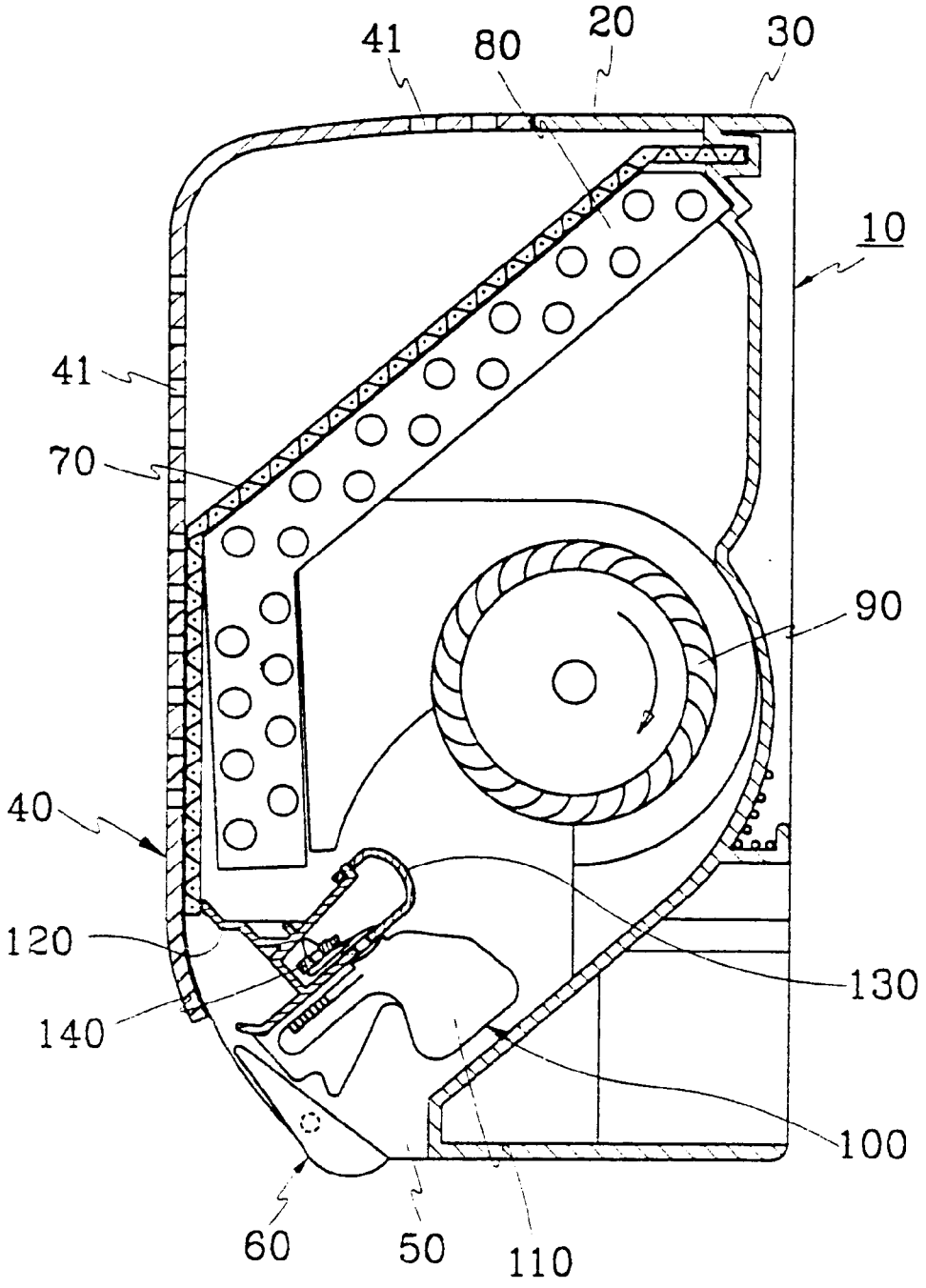
FIG. 1 (PRIOR ART)
FIG. 1 is a vertical sectional view through an indoor unit of an air conditioner according to the prior art.
Figure 2:
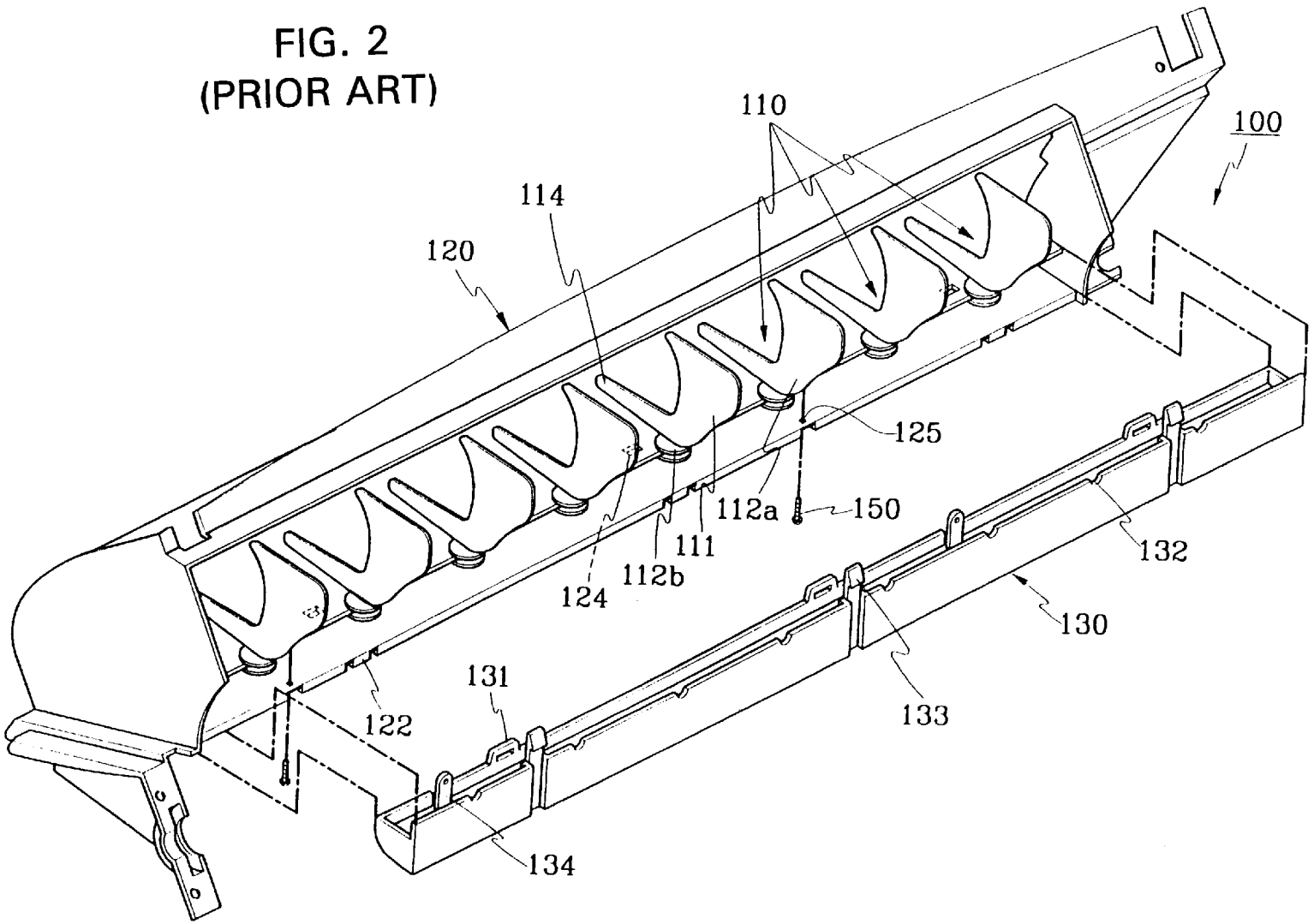
FIG. 2 (PRIOR ART)
FIG. 2 is a partially exploded perspective view for illustrating a bottom of a horizontal air direction control means according to the prior art.
Figure 3:
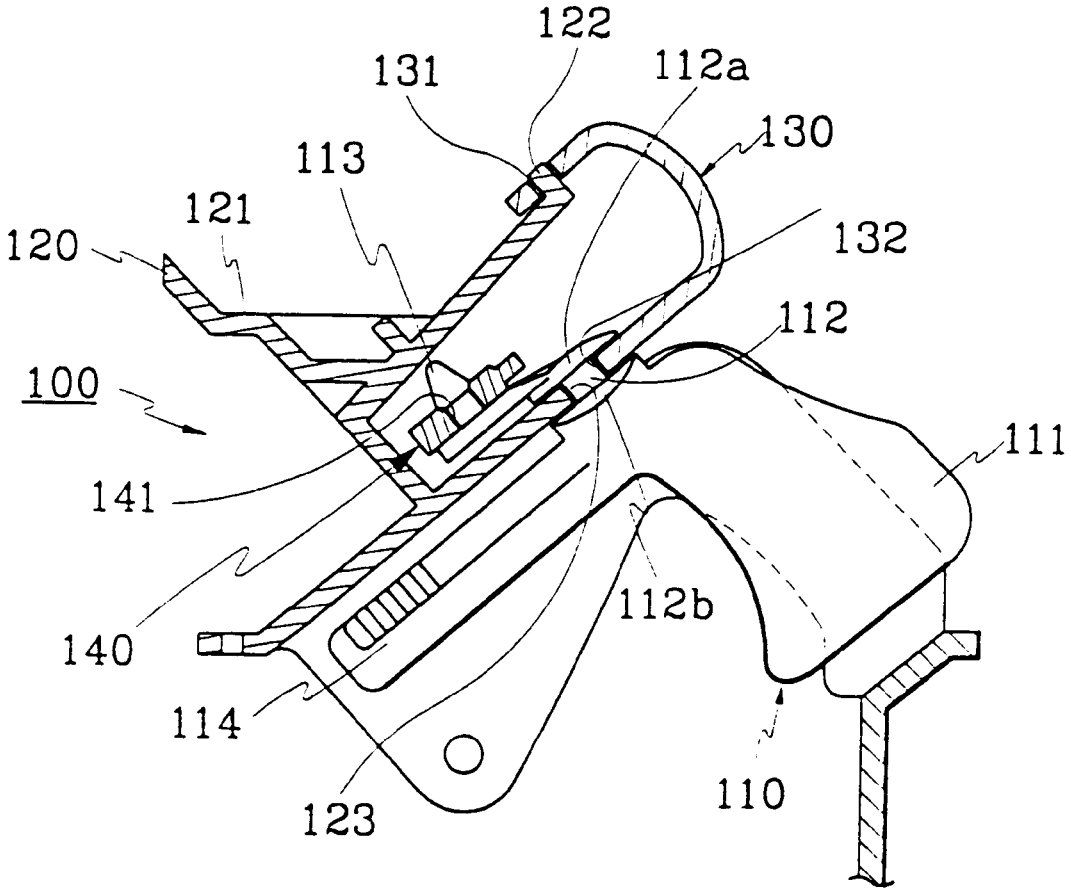
FIG. 3 (PRIOR ART)
FIG. 3 is a sectional view of the horizontal air direction control means according to the prior art.
Figure 4:
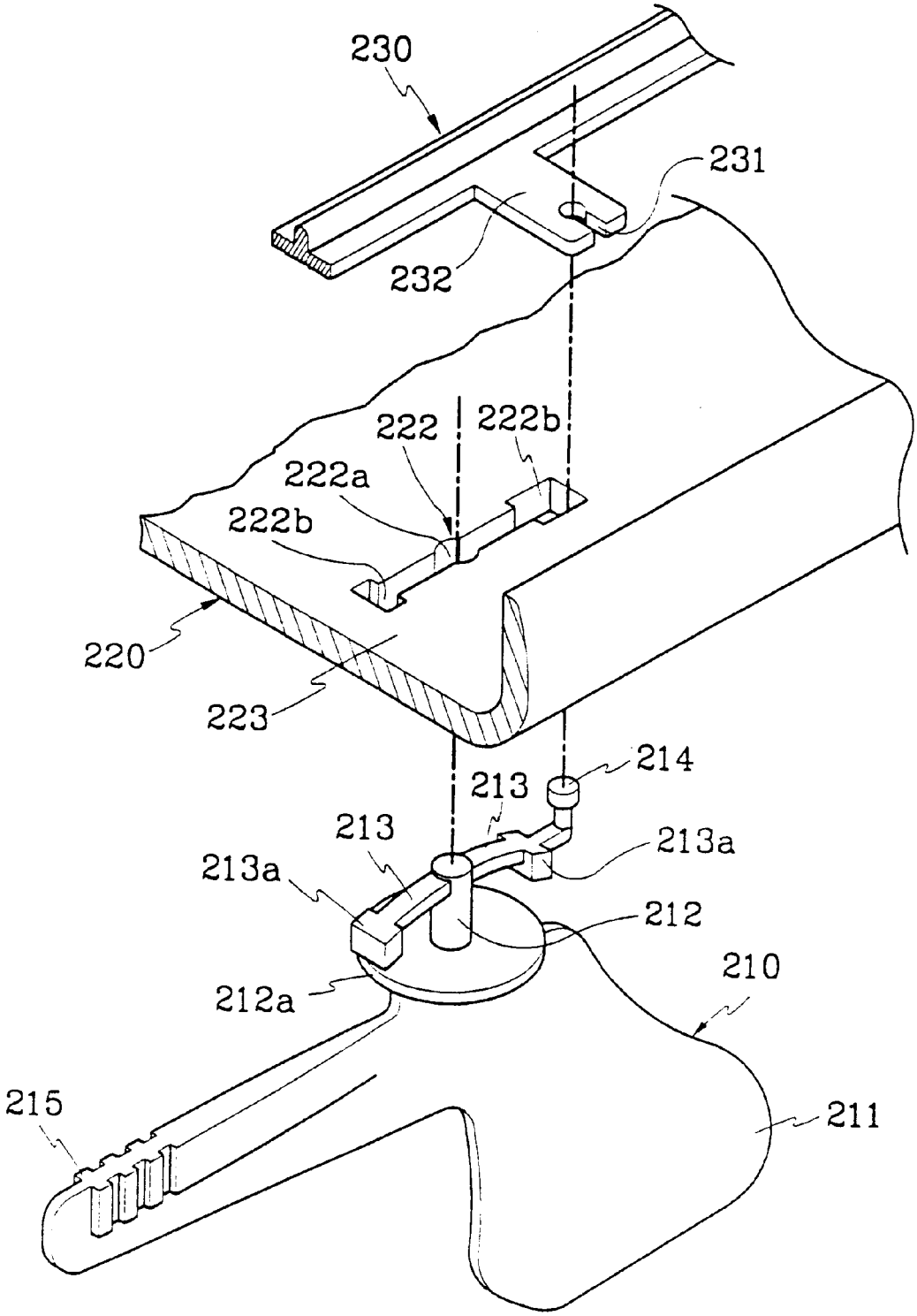
FIG. 4 is an exploded perspective view for illustrating a horizontal air direction control means according to the present invention.

The preferred embodiment of the present invention will now be described in detail with reference to the accompanying drawings.

Horizontal air direction control means 200 according to the present invention includes a plurality of swing vanes 210 for horizontally controlling flow directions (i.e., right-left directions) of the air discharged through a discharge outlet 50 and a support member 220 for collecting the condensed water condensing on an evaporator 80 to drain same outside. The support member 220 supports the plurality of swing vanes 210 for swinging movement. A connecting member 230 is disposed above the support member and is connected to the swing vanes such that the plurality of swing vanes 210 can be simultaneously swung through identical angles.

Each of the swing vanes 210 includes a body 211 and integrally formed at an upper end of the body 211 is a projection. The projection includes a hinge 212 having a flange 212a at a bottom end thereof. The axle 212 projects through the support member 220 and is coupled thereto for horizontal swinging. The hinge axle 212 is integrally and symmetrically formed at an upper end thereof with compression protruders 213 so as to engage an upper surface of the support member 220 for supporting the body 211 after the compression protruders 213 have been extended through the body and rotated at a predetermined angle. One end of each of the compression protruders 213 is integrally formed with a drive coupling in the form of a fixation axle 214 eccentrically positioned at a predetermined distance from the hinge axle 212, the fixation axle 214 being coupled to the connecting member 230 for movement therewith. The body 211 is integrally formed at a front end thereof with a handle 215 to allow a user to manually swing the plurality of swing vanes 210.

The compression protruders 213 are formed to bend downward at both ends thereof in gradual curvature when they are extruded at manufacture. Thus the protruders resiliently engage the upper surface of the support member 220 for the prevention of unnecessary sway when the body 211 is horizontally swung, and the protruders 213 are integrally formed at the bottom surface thereof with enlarged contact surfaces 213a in order to closely contact the upper surface of the support member 220.

Meanwhile, the support member 220 is formed at one end thereof with a drain tray surface 221 so as to gather the condensed water flowing from an evaporator 80 and to drain same via a drain hose (not shown). The support member 220 is formed at the other end thereof with a coupling surface 223 having coupling slots 222 configured correspondingly to the projections of the vanes 210 so that each projection can be inserted through a respective coupling slot 222. Then, by rotating the vane about the hinge axle 212, the vane becomes secured to the support member in the manner of a bayonet coupling.

Figure 5:
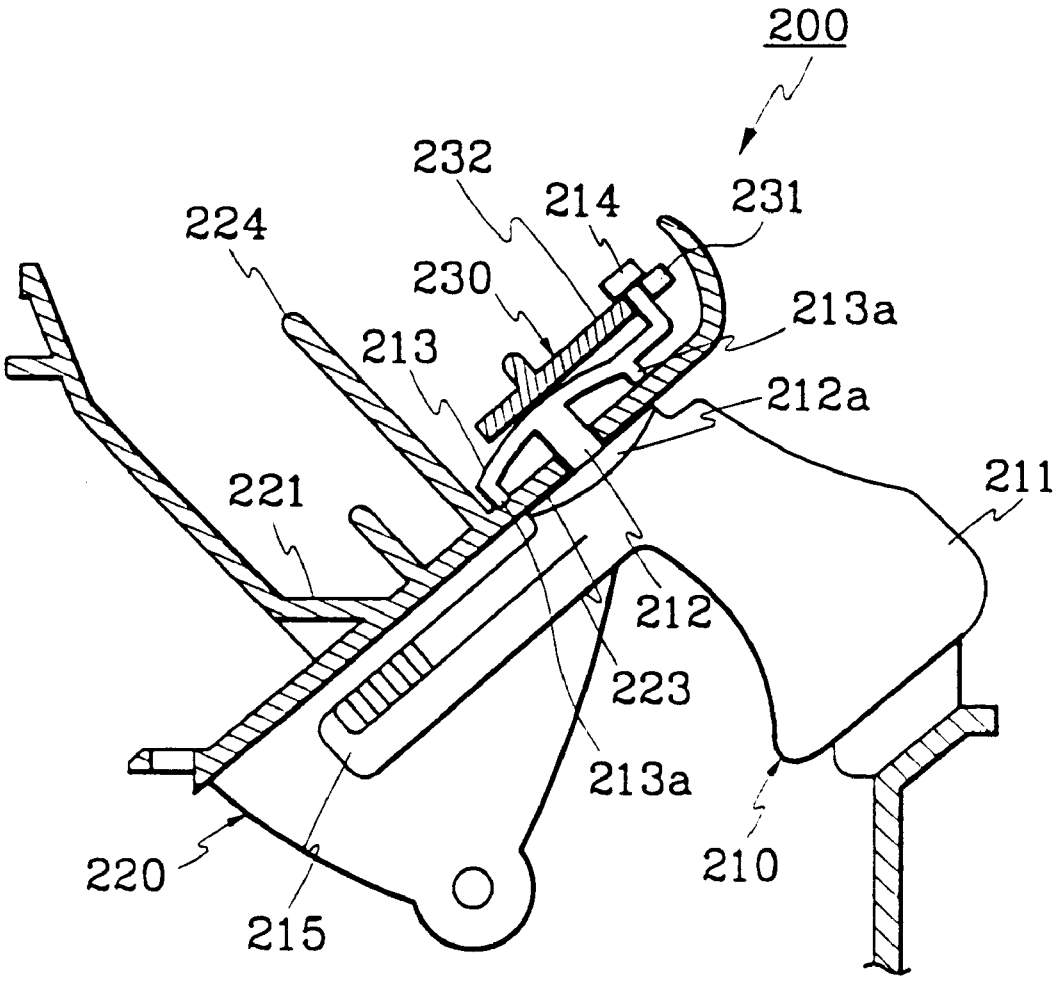
FIG. 5 is a sectional view of the horizontal air direction control means according to the present invention.
Figure 6A:
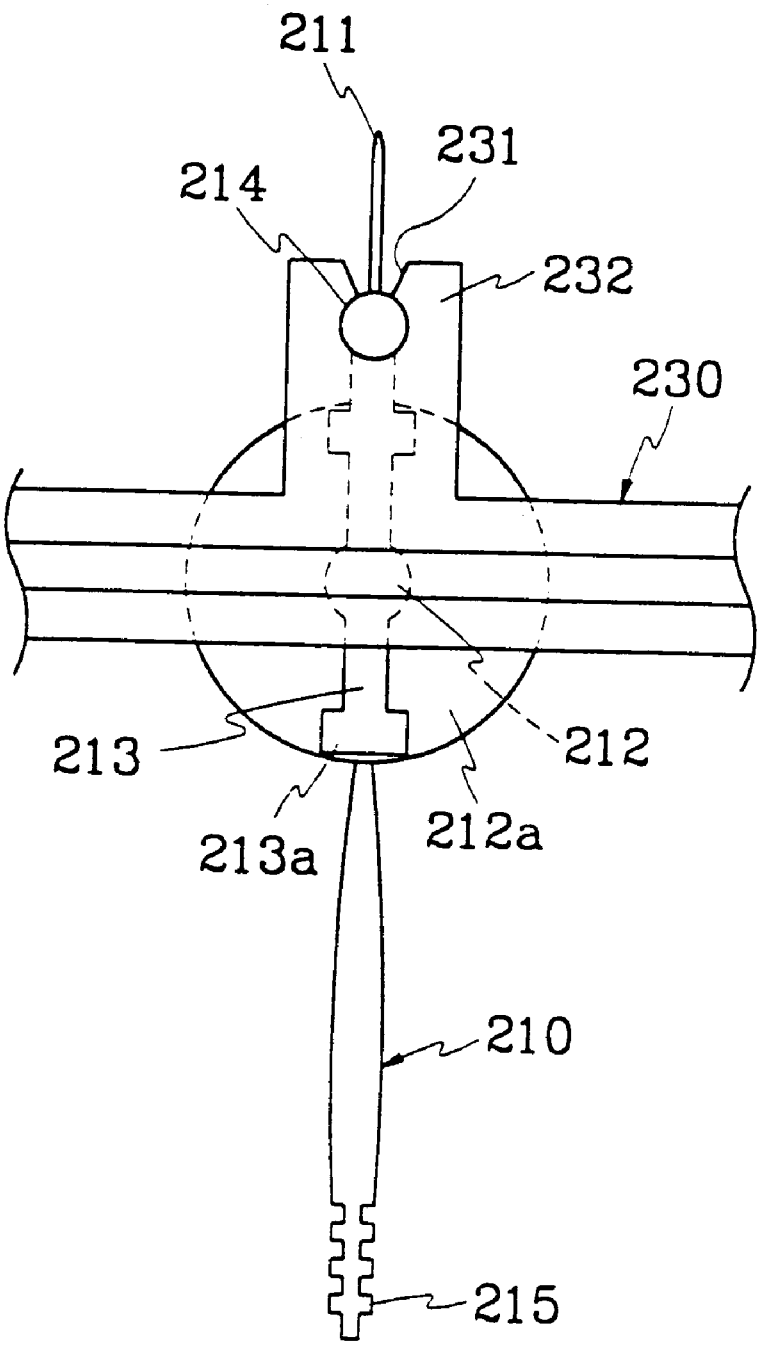
FIGS. 6A and 6B are plan views for schematically illustrating horizontal air direction states of vanes according to the present invention.
Figure 6B:
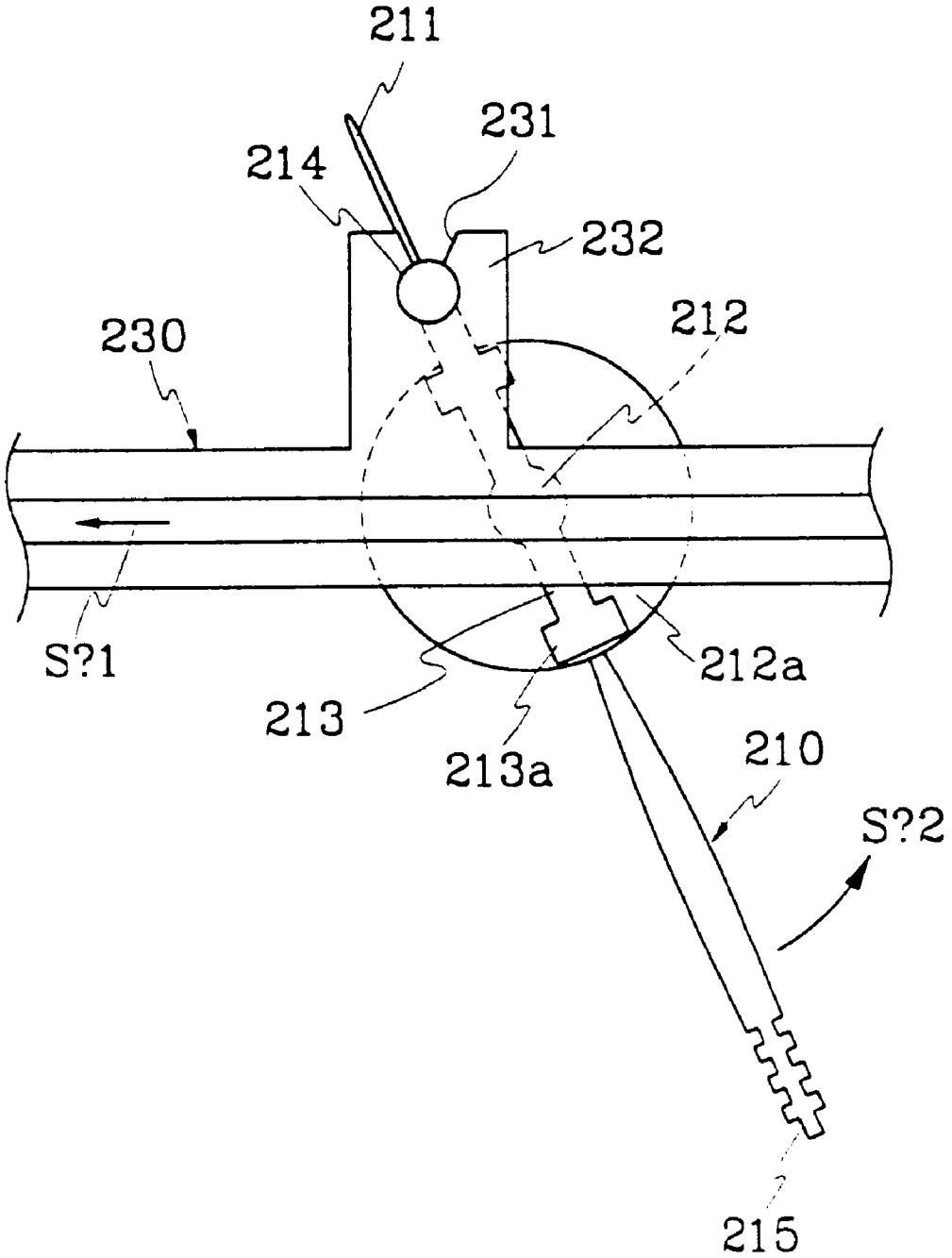

At a boundary between the drain tray surface 221 and the coupling surface 223 there is integrally and upwardly formed a boundary surface 224 (FIG. 5) to prevent the water gathered on the drain tray surface 221 from flowing toward the coupling slots 222.

At this time, each coupling slot 222 includes a central circular enlargement 222*a* for receiving the hinge axle 212. The axle can rotate, but it cannot be displaced along the length of the support member.

The central enlargement 222*a* is symmetrically formed at opposite sides thereof with elongated holes 222*b* enabling the compression protruders 213 to pass therethrough. Each hole 222*b* has a width that is less than a diameter of the center hole 222*a* so that the hinge axle 212 is confined to the center hole.

The connecting member 230 is in the shape of a rod having a predetermined thickness and is integrally formed with a protruder 232 having a plurality of open-sided fixation holes 231 spaced apart lengthwise at predetermined intervals so as to receive, with a friction fit, the fixation axles 214 formed on the plurality of swing vanes 210. The fixation axles can be snapped into the fixation holes 231.

Now, the operational effect of the present invention thus constructed will be described.

Figure 7:
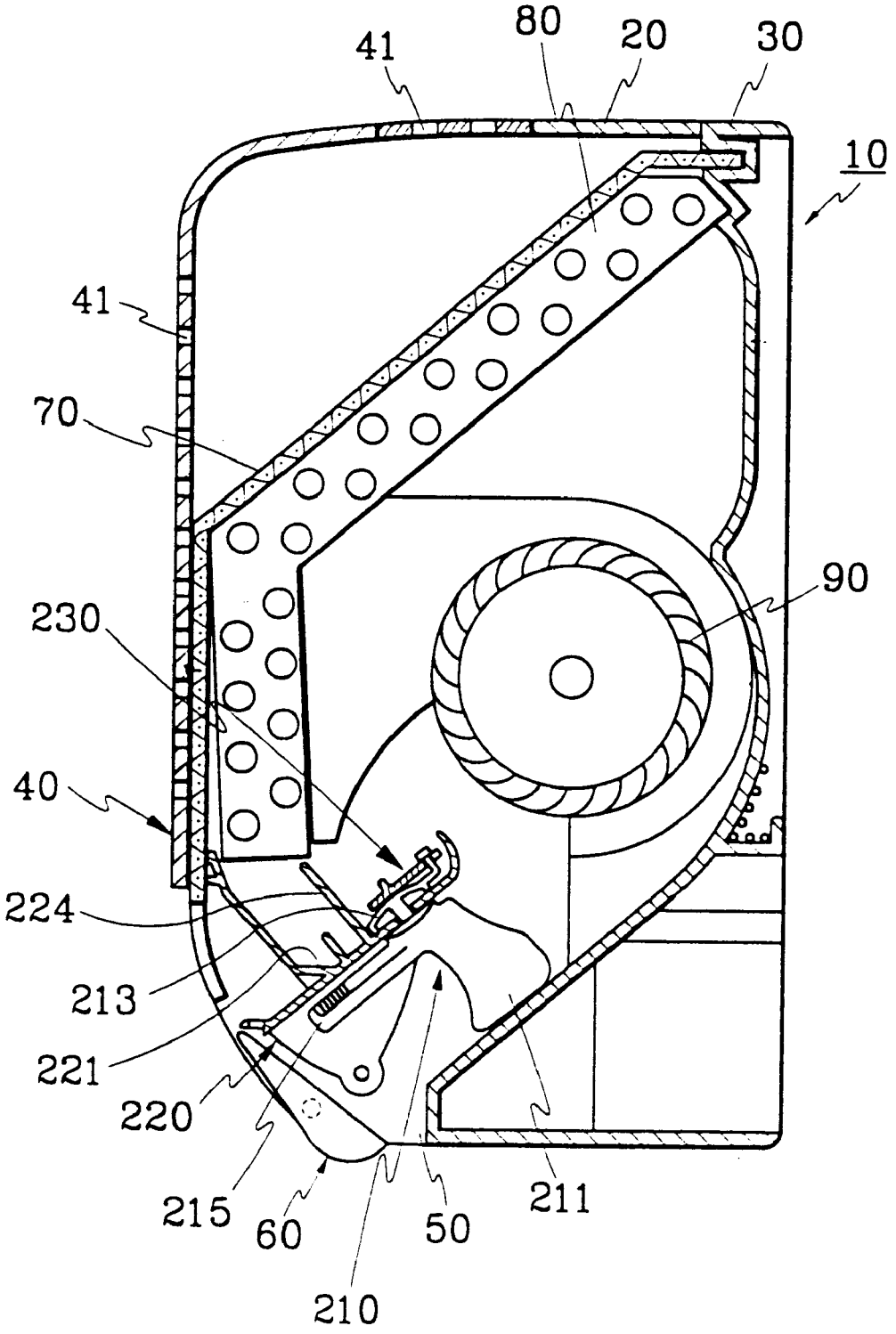
FIG. 7 a vertical sectional view through the indoor unit according to the present invention.

As illustrated in FIG. 7, when power is applied by a remote control to activate the air conditioner, the blower 90 in the indoor unit 10 is rotated to cause the room air to be sucked into the room via suction inlet 41 and to have foreign objects floating in the air filtered. The filtered air is now heat-exchanged into hot or cool air by passing through the evaporator 80 and is discharged indoors to lower or raise the temperature of regions of the room according to the orientation of the horizontal and vertical air direction control means 200 and 60.

At this time, the horizontal air direction control means 200 is operated by the connecting member 230, which can be moved to the left (S1) or to the right at a predetermined distance by a driving motor (not shown) to rotate the fixation axles 214.

When the connecting member 230 is moved to the left or to the right, the vanes 210 are swung clockwise or counterclockwise.

When the connecting member 230 is moved by a force to the left or to the right, the force is evenly transmitted to the fixation axles 214, whereby no excessive force is applied to the connection member 230 and to the coupled area with the plurality of horizontal swing vanes 210.

The compression protruders 213 horizontally and symmetrically protruding from opposite sides of the hinge axle 212 resiliently engage the upper surface 233 of the coupled surface 223 of the support member 220 to cause the flange 212*a* to tightly contact the bottom surface of the support member 220 so that, when the plurality of swing vanes 210 are swung, they are softly guided to resist the creation of frictional noises.

When the swing vanes 210 are manually operated, i.e., when one of the handles 215 disposed thereat is pushed either to the left or to the right at a predetermined angle desired by the user, all of the swing vanes 210 are rotated simultaneously since they are interconnected by the connecting member 230.

As is apparent from the foregoing, there is an advantage in the horizontal air direction control apparatus of an air conditioner according to the present invention in that, construction is simple and facilitates assembly of the apparatus, and reduces cost. That is, the apparatus employs fewer parts because the swing vanes are respectively mounted merely by having their projections inserted through respective slots and then rotated. Also, the fixing axles are mounted to the fixing holes of the connection member by a simple snap-in coupling.

There is another advantage in that horizontal swinging of the swing vanes is softly and smoothly guided to reduce frictional noises.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A horizontal air direction control apparatus of an air conditioner including an air inlet;

an air outlet;

a heat exchanger disposed between the air inlet and the air outlet; and an air direction control mechanism mounted at the air outlet for regulating a discharge direction of the air and the apparatus including:

a support member having a drain tray surface for collecting condensed water from the heat exchange, and a plurality of coupling slots, a plurality of horizontal swing vanes, each vane including a projection having a hinge axle and an eccentric drive coupling offset from the hinge axle, the projections configured correspondingly to the coupling slots so that each projection is insertable through a respective one of coupling slots and then securable to the support member in response to a turning of the projection about the hinge axle, and a connecting number connected to the drive couplings and being slidable for simultaneously rotating all of the horizontal swing vanes.

2. The apparatus according to claim 1 wherein each of the projections includes a pair of compression protruders extending from opposite sides of the hinge axle, the compression protruders arranged to bear elastically against a upper surface of the support member.

3. The apparatus according to claim 2 wherein each hinge axle is connected to a flange which does not extend through the respective one of the coupling slots, each flange being pulled into contact with a bottom surface of the support member by the engagement of the compression protruders with the upper surface of the support member.

4. The apparatus according to claim 2 wherein one of the compression protruders of each horizontal swing vane carries the respective drive coupling.

5. The apparatus according to claim 1 wherein each drive coupling comprises a fixation axle extending parallel to the respective hinge axle.

6. The apparatus according to claim 1 wherein the connecting member includes a plurality of open-sided fixation holes into which respective fixation axles can be frictionally pushed.

7. The apparatus according to claim 2 wherein each of the compression protruders is bent in a gradual curvature toward the upper surface of the support member.

8. The apparatus according to claim 2 wherein each of the compression protruders includes an enlarged contact surface engaging the upper surface of the support member.

9. The apparatus according to claim 1 wherein the support member includes a boundary surface for preventing condensed water in the drain tray surface from traveling to coupling slots.

10. The apparatus according to claim 1 wherein each of the slots includes a central circular enlargement for receiving the hinge axle; and elongated holes extending from opposite sides of the central circular enlargement a width of each of the elongated holes being less than a diameter of a central circular enlargement.

* * * * *